US007240524B1

(12) United States Patent
White et al.

(10) Patent No.: US 7,240,524 B1
(45) Date of Patent: Jul. 10, 2007

(54) LOCKING APPARATUS FOR A GARAGE DOOR

(76) Inventors: Bryan A. White, 322 No. El Camino Real, Suite C, Encinitas, CA (US) 92024; Clyde D. Herman, 11976 Calle Deposito, El Cajon, CA (US) 92019

( * ) Notice: Subject to any disclaimer, the term of this patent is extended or adjusted under 35 U.S.C. 154(b) by 0 days.

(21) Appl. No.: 11/384,714

(22) Filed: Mar. 20, 2006

Related U.S. Application Data

(63) Continuation-in-part of application No. 10/869,329, filed on Jun. 15, 2004, now abandoned.

(51) Int. Cl.
*E05B 47/00* (2006.01)

(52) U.S. Cl. ..... 70/257; 49/449; 70/279.1; 70/280; 70/DIG. 11; 292/39; 292/144; 292/DIG. 36

(58) Field of Classification Search ..... 70/279.1, 70/257, 280–282, 278.7, DIG. 11; 292/35, 292/36, 39, 144, DIG. 36; 49/197, 449; 160/207, 213
See application file for complete search history.

(56) References Cited

U.S. PATENT DOCUMENTS 3,584,905 A * 6/1971 Emenaker ..... 292/38
3,907,343 A * 9/1975 Goodwin ..... 292/33
3,947,060 A * 3/1976 Zimmer et al. ..... 292/142
3,996,591 A * 12/1976 Hayward ..... 292/3
4,080,757 A * 3/1978 Westerman ..... 49/322
4,543,748 A * 10/1985 North, Jr. ..... 49/395
4,618,174 A * 10/1986 Duke ..... 292/135
4,668,899 A * 5/1987 Ide et al. ..... 318/280
4,819,379 A * 4/1989 Kenzelmann et al. ..... 49/280
4,884,831 A * 12/1989 Emon ..... 292/38
5,404,737 A * 4/1995 Hotzl ..... 70/279.1
6,382,005 B1 * 5/2002 White et al. ..... 70/277

* cited by examiner

*Primary Examiner*—Lloyd A. Gall
(74) *Attorney, Agent, or Firm*—Jack C. Munro

(57) ABSTRACT

A locking apparatus for a garage door which utilizes a pair of actuators with one actuator being mounted at a side edge of the garage door and the other actuator mounted at the opposite side edge of the garage door. One actuator is mounted on a carrier gear which connects to a worm gear which is driven by an electric motor. Each operator connects with a locking bolt with there being a separate locking bolt for each actuator. Each locking bolt is to be movable in conjunction with the door jamb of the garage door to lock the garage door to the jamb. Both actuators pivot in the same direction. Both locking bolts are linearly slidable. A connecting member connects between the first actuator and the second actuator so that the actuators move in unison. One actuator has a back end which extends through a slot formed in a latch housing. This back end is manually accessible to cause the actuator to move manually if electricity fails.

6 Claims, 4 Drawing Sheets

LOCKING APPARATUS FOR A GARAGE DOOR

REFERENCE TO PRIOR APPLICATION

This application is a continuation-in-part of U.S. patent application Ser. No. 10/869,329, filed Jun. 15, 2004 now abandoned, entitled LOCKING APPARATUS FOR A GARAGE DOOR by the present inventors.

BACKGROUND OF THE INVENTION

1. Field of the Invention

The field of this invention relates to a door locking apparatus and more particularly to a door locking apparatus for a garage door that is to be activated by means of a remote control with the door locking apparatus to prevent unauthorized opening of the garage door.

2. Description of the Related Art

The subject matter of the present invention is deemed to be an improvement over U.S. Pat. No. 6,382,005, issued on May 7, 2002, by the present inventors. The subject matter of this invention achieves the same objective as the aforementioned patent but constitutes a far less complex structure which can be manufactured at less cost and thereby sold to the ultimate consumer at less cost. Automatic garage door mechanisms have now become exceedingly common in conjunction with garage doors of residences, such as houses, condominiums and apartments. These garage door opening mechanisms are principally for the purpose of allowing the user the convenience to open his or her garage door by a radio actuated switch, which is commonly referred to as a remote. Conventional garage door operating mechanisms are intended to provide security for the garage door so that when the garage door is in the closed position, the garage door is to be maintained closed unless it is actuated only by the individual with the remote. However, this has been known to impart a false sense of security for the garage door as residential burglary is commonly achieved by burglars which pry open the garage door.

One common form of garage door is having the door constructed of a single flat piece with the flat piece to be pivoted from a vertically oriented position when the garage door is closed to a substantially horizontal position when the garage door is open. Another common form of garage door is where the garage door is made of a series of panels. These panels are in alignment with each other when the door is closed. Opening of the garage door causes the panels to sequentially pivot from a vertical position to a horizontal position, and when the garage door is in the fully open position, the panels again are again in alignment. When the garage door is in the closed position, it is possible for a burglar to pry open the bottom edge of the garage door to create an opening of sufficient size that would permit a burglar to wiggle through the opening and gain access to the interior of the garage. After burglarizing of the residence, the burglar may load burglarized goods into a vehicle that is located within the garage, then start the vehicle, open the garage door and proceed with an unnoticed escape.

In the past, it has been known to provide solenoid actuated latches in the lower corner of the garage door that, when latched, would prevent a person from causing an unauthorized opening of the garage door. However, these solenoid types of latches are large in size and inherently expensive. Also, the mounting arrangement for the latches is complex with this complexity greatly increasing the cost of the installation of such a locking arrangement.

In the past, it has been known to utilize a separate manual garage door unlocking mechanism. While satisfactory for the intended purpose, such manually operated locking mechanisms are not readily adaptable for use with garage doors that incorporate automatic openers as such would not provide the convenience of automatic operation. In other words, with an individual approaching a garage door with one's car, it would require that the individual leave the car, go the garage door, open the garage door, and then get back into the car and move the car within the garage. The individual then would be required to exit the car and close the garage door prior to entering within the residence. It is far more convenient to use a remotely operated opening mechanism which does not require that the individual leave the car in order to gain access to within the garage and then can close the garage door as the individual is entering the residence not requiring the procedure of separately closing the garage door.

SUMMARY OF THE INVENTION

The basic embodiment of locking mechanism for a garage door of the present invention utilizes a first actuator designed to be pivotally mounted on the garage door directly adjacent a first side edge of the garage door and a second actuator designed to be pivotally mounted on the garage door directly adjacent a second side edge of the garage door. The first actuator is mounted on a carrier gear. A worm gear connects with the carrier gear. An electric motor rotates the worm gear hence pivoting of the carrier gear and the first actuator. The first actuator is mounted on a latch housing. A connecting member connects together both the first actuator and the second actuator so both the first actuator and the second actuator will move in unison. A first locking bolt is connected to the first actuator with sliding movement of the first locking bolt to occur between a first locking position in conjunction with the door jamb of the garage door and a first unlocking position spaced from the door jamb. The first locking bolt has a cutout which has a cutout wall. The first actuator has a rounded end which has a somewhat flattened configuration. This flattened configuration is to abut against this cutout wall when the first locking bolt is in the first locking position producing an "over-the-center" position which prevents movement of the first locking bolt by interference being created. Movement of the first locking bolt is only possible by initiating movement of the first actuator. The first actuator has a back end which extends through a slot formed in the latch housing. The first actuator extends exteriorly of the latch housing. The back end is manually accessible to cause the first actuator to pivot to cause the first locking bolt to move. A second locking bolt is connected to the second actuator. Movement of the second actuator causes sliding movement of the second locking bolt between a second locking position in conjunction with the door jamb and a second unlocking position spaced from the door jamb. With the first locking bolt in the first locking position and the second locking bolt in the second locking position, the garage door is fixed to the door jamb. With the first locking bolt in the first unlocking position and the second locking bolt in the second unlocking position, the garage door is movable relative to the door jamb that will permit the garage door to move from a closed position to an open position, and vice versa.

A further embodiment of the present invention is where the basic embodiment is modified by having the first actuator being designed to be connected to a limit switch with this limit switch to deactivate movement of the actuators when the garage door is in the fully closed position and also in the fully open position.

A further embodiment of the present invention is where the first basic embodiment is modified by the first locking bolt being movable in a direction opposite to movement of the second locking bolt.

A further embodiment of the present invention is where the basic embodiment is modified by both the first locking bolt and the second locking bolt each being linearly movable.

A further embodiment of the present invention is where the basic embodiment is modified by having the pivotable movement of the first actuator being in the same direction as the pivotable movement of the second actuator.

A further embodiment of the present invention is where the basic embodiment is modified by defining the connecting member as a thin rod.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
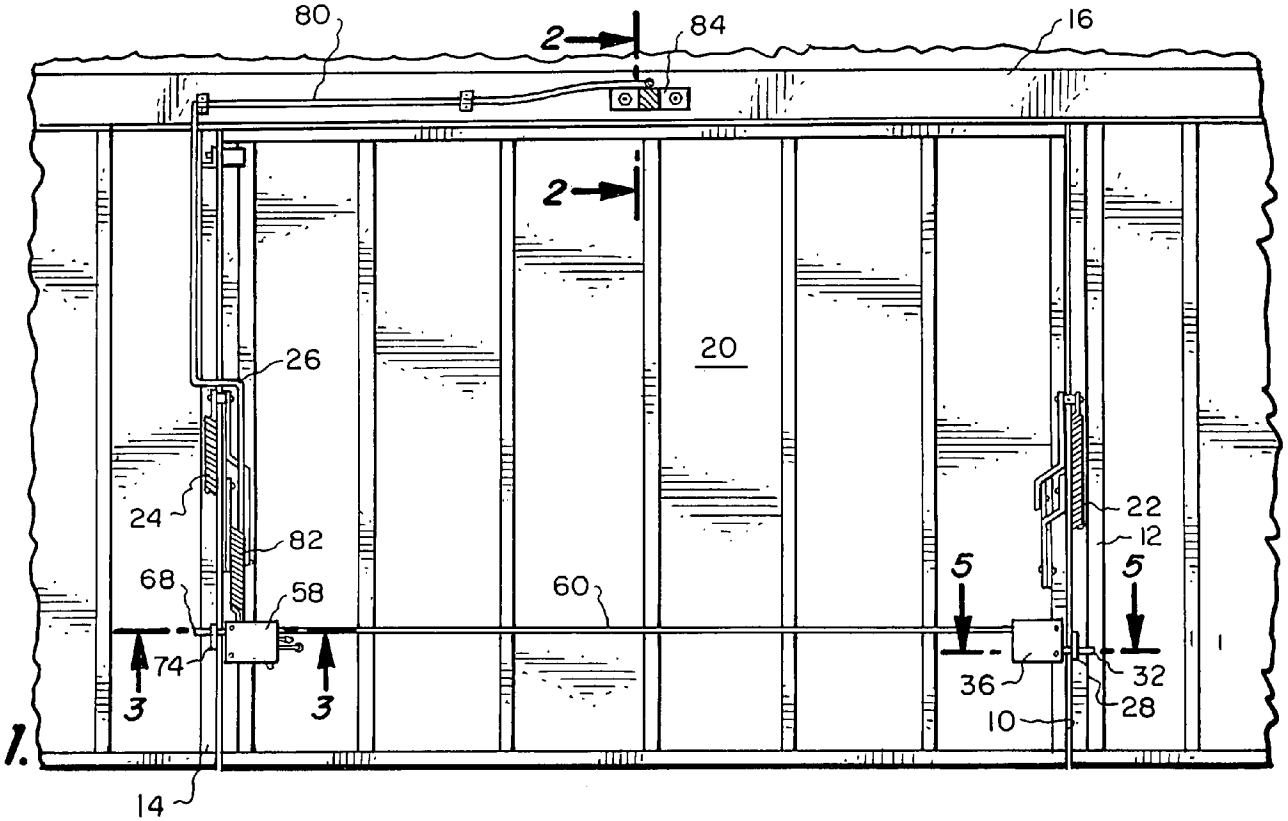
FIG. 1 is an elevational view of an inside surface of a garage door on which is being mounted the locking apparatus of the present invention.
Figure 2:
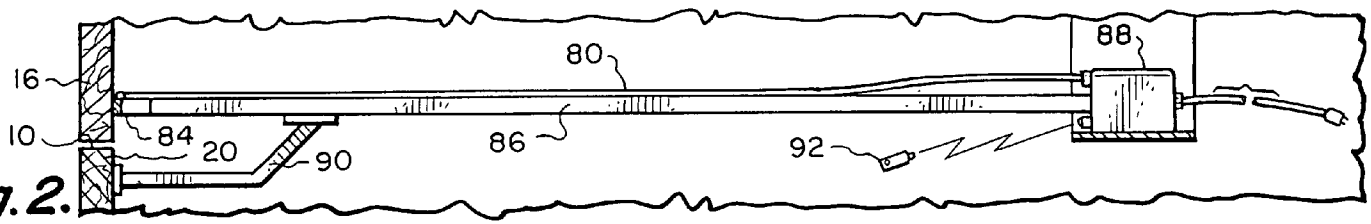
FIG. 2 is a cross-sectional view taken through a portion of the locking mechanism of the present invention taken along line 2-2 of FIG. 1.
Figure 3:
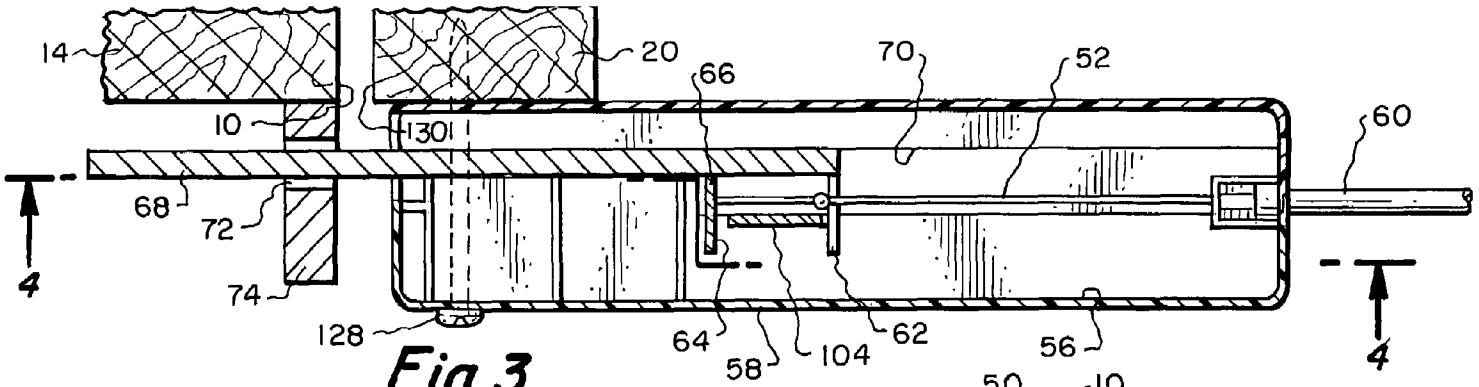
FIG. 3 is a cross-sectional view through the first actuator assembly utilized in conjunction with the locking apparatus of the present invention.
Figure 5:
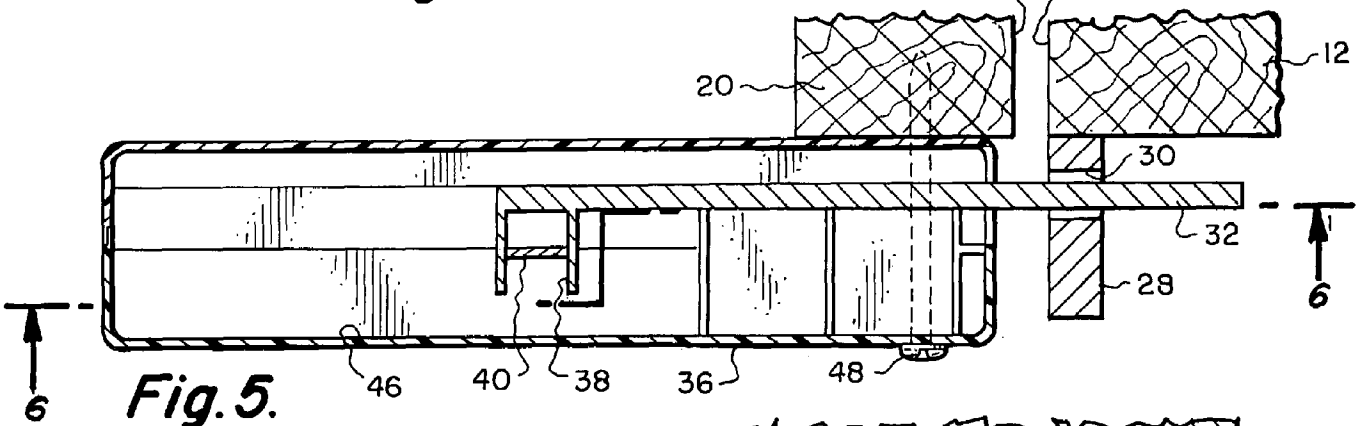
FIG. 5 is a cross-sectional view through the second actuator assembly utilized in conjunction with the locking apparatus of the present invention taken along line 5-5 of FIG. 1.
Figure 7:
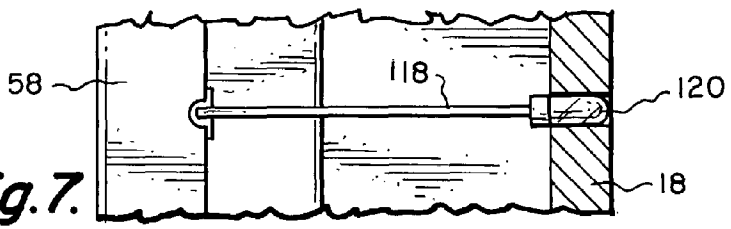
FIG. 7 is a cross-sectional view taken through the garage door to show the mounting of an indicator light in conjunction with the garage door which indicates that the garage door is in a locked position taken along line 7-7 of FIG. 4.

Referring particularly to FIG. 1 of the drawings, there is shown a garage door opening 10 which is formed between a right side door jamb 12 and a left side door jamb 14. The door jambs 12 and 14 are connected together at their top edge by a header 16. The header 16 as well as the jambs 12 and 14 form part of a vertical building or house wall 18. A garage door 20 is mounted within the opening 10. The garage door 20 is mounted in a manner to substantially be capable of closing of opening 10. The garage door 20 is counterbalancingly supported by spring assemblies 22 and 24 which will permit the garage door 20 to be opened with a low amount of force. The garage door 20 is to pivot by means of a linkage assembly, which is not shown, about a pivot axis 26, which is depicted within FIG. 1. There will be attached to the door 20 an automatic garage door opening mechanism, which will be described later.

Mounted on the right side door jamb 12 is a latch plate 28. Although a separate latch plate 28 is shown, it is considered to be within the scope of this invention that instead of a latch plate there could be just formed a hole directly within the door jamb 12. The latch plate 28 includes a through hole 30. A locking bolt 32, which comprises a rigid metallic bar, is to be extendable through the hole 30.

The locking bolt 32 is slidingly mounted within a channel 34 formed within a latch housing 36. The locking bolt 32 includes a cutout 38 located intermediate the ends of the locking bolt 32. Mounted within the cutout 32 is a ball shaped or rounded end 40 of an actuator 42. Actuator 42 comprises an elongated lever which is mounted on a pivot pin 44 intermediate the ends of the actuator 42. The pivot pin 44 is mounted on the latch housing 36. It is to be understood that the actuator 42 is located within internal chamber 46 of the latch housing 36. The latch housing 36 is fixedly mounted by nails, screws or other similar type of fasteners 48 to the door 20 directly adjacent the right edge 50 of the door 20. It is to be understood that there will be used a plurality of the fasteners 48.

Extending within the internal chamber 46 is one end of a rod 52. The rod 52 is mounted within a hole 54 formed in one end of the actuator 42. The rod 52 extends exteriorly of the latch housing 36 until the rod 52 passes within internal chamber 56 of a latch housing 58. Latch housing 58 is also mounted on door 20 but directly adjacent the left edge of door 20. The rod 52, in between the latch housings 36 and 58, may be covered as with an elongated plastic sleeve 60. The end of the rod 52 that is located within the internal chamber 56 is conducted through a hole in cutout wall 62 which forms one end of a cutout 64. Cutout wall 62, as well as cutout wall 66, are formed integral with locking bolt 68. Locking bolt 68 is slidable within a channel 70 formed within the latch housing 58. The outer end of the locking bolt 68 extends exteriorly of the latch housing 58 and passes through a hole 72 formed within a latch plate 74. Latch plate 74 is fixedly mounted onto the left side door jamb 14. Again, instead of using latch plate 74, there actually could be formed just a hole within the left side door jamb 14.

The rod 52 extends entirely across the cutout 64. Retraction of the rod 52 from the cutout 64 is prevented by means of bulbous member 76 which is fixedly secured to the rod 52 directly adjacent the cutout wall 62. Mounted within the latch housing 58 is a motor 78. Motor 78 is to be operated electrically by means of an electrical wire assembly 80. The electrical wire assembly 80 is formed into a tightly wound coil 82 which is conducted along the pivot axis 26 to the left side door jamb 14 and then extends up to the header 16. The electrical wire assembly 82 then connects to an electronic controller 88. Bracket 84 is mounted on header 16 and is used to mount one end of rail 86 of the garage door opener. Movably mounted on the rail 86 is a link 90 which connects to the garage door 20. Actuating of the controller 88 by means of a hand held remote 92 will result in the link 90 being moved along the rail 86 which will result in opening of the garage door 20 from the closed position to the open position. Actuating of the remote 92 again will result in reverse movement of the link 90 and result in closing of the garage door 20.

Figure 4:
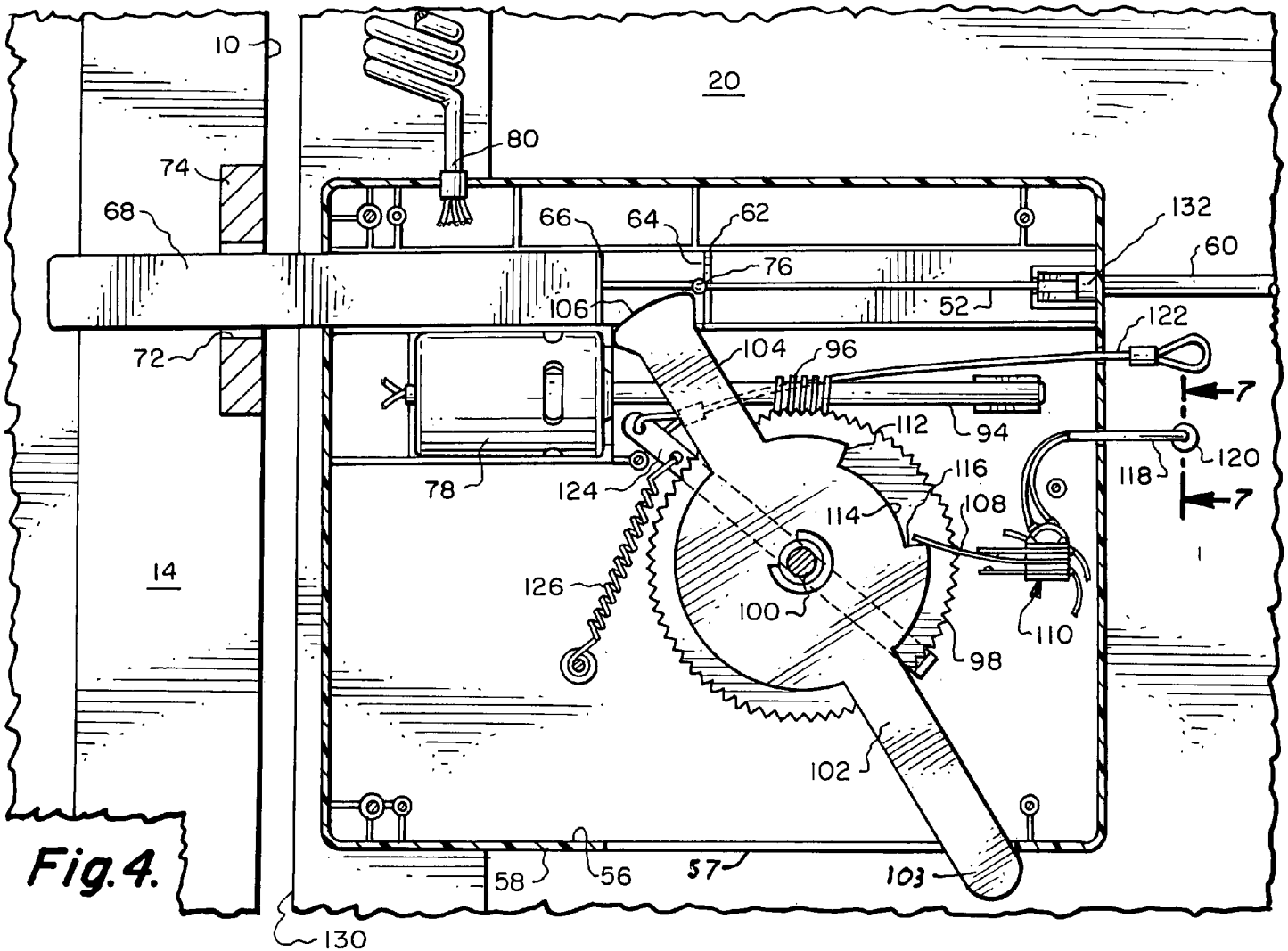
FIG. 4 is a cross-sectional view through the first actuator assembly of the present invention taken along line 4-4 of FIG. 3.
Figure 6:
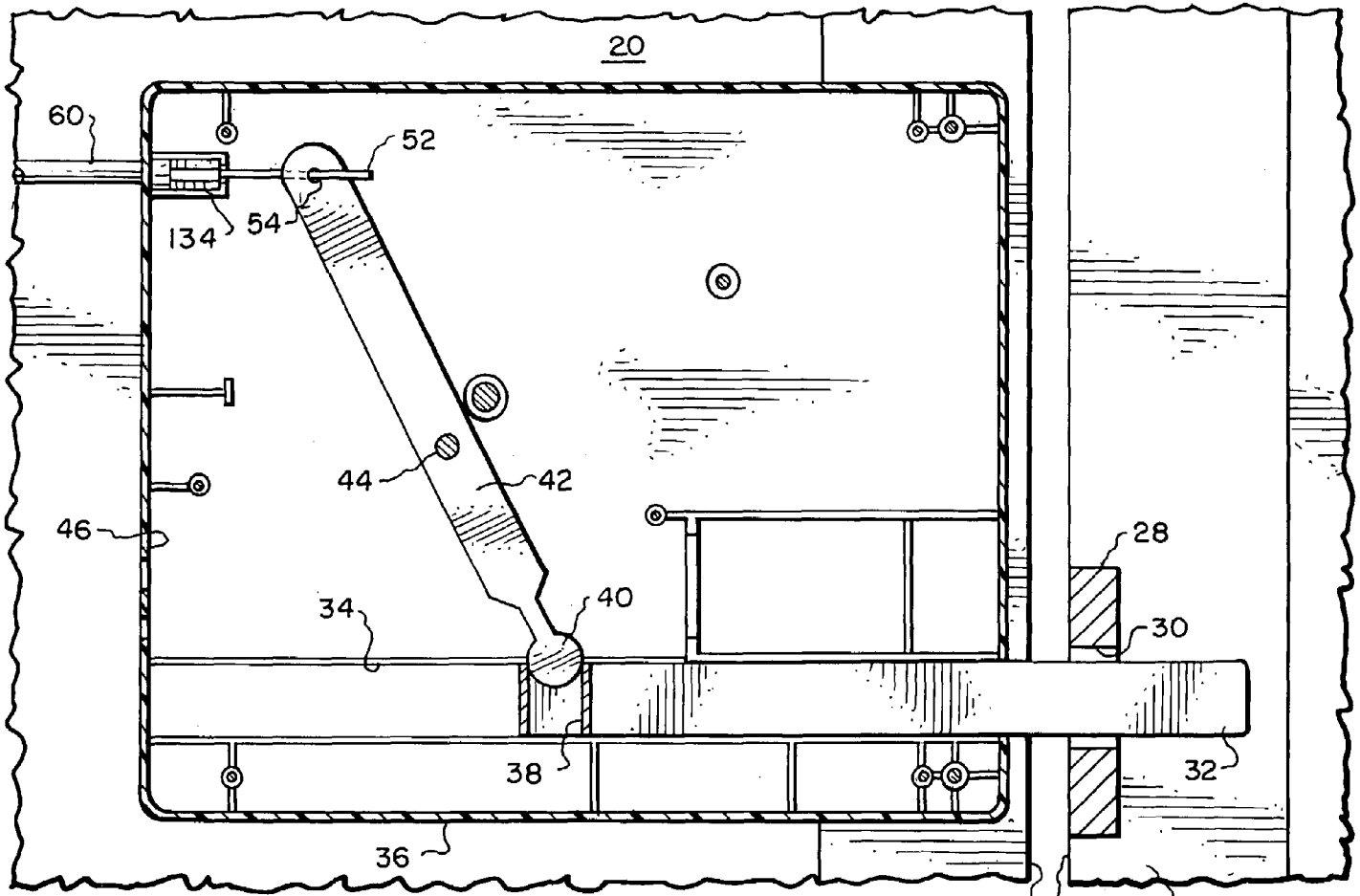
FIG. 6 is a cross-sectional view through the second actuator assembly included within the locking apparatus of the present invention taken along line 6-6 of FIG. 5.

Included in conjunction with the controller 88 is the appropriate controls for operating of the locking apparatus of the present invention. These controls also will be operated by a remote similar to remote 92 or could even be the same remote. Activating of that remote manually will result in an electrical voltage being applied to the motor 78. Activation of motor 78 causes turning of shaft 94. Shaft 94 has mounted thereon a worm gear 96. Worm gear 96 engages with a carrier gear 98. Carrier gear 98 is pivotally mounted on a pivot pin 100 which is mounted on the latch housing 58. Also mounted on the pivot pin 100 is an actuator 102 in the form of an elongated lever. The actuator 102 has a front end 104 which is formed into a rounded end 106. The rounded end 106 rides within the cutout 64. Activation of the motor 78 will cause the worm gear 96 to rotate and also cause rotation of the carrier gear 98 as well as the actuator 102. This will cause the rounded end 106 to force linear movement of the cutout 64 resulting in the locking bolt 68 to be moved from the position shown in FIG. 4 to a position where the locking bolt 68 is substantially totally confined within the latch housing 58. The actuator 102 is pivoted in a clockwise direction, as is readily apparent in FIG. 4 of the drawings. The rod 52, being also connected to actuator 42, causes actuator 42 to pivot clockwise. The end 40 of the actuator 42 riding within cutout 38 will cause the locking bolt 32 to move linearly and also be substantially totally confined within its internal chamber 46 of the latch housing 36. At this particular time, the reed 108 of a reed switch assembly 110 abuts against shoulder 112 of a slot 114 formed within the actuator 102. The reed switch assembly 110 will then cause shut down of the motor 78 not permitting any further rotation of the worm gear 96. In this particular position, the garage door 20 can be pivoted within the opening 10.

If for reason of electrical failure it is desired to operate the locking apparatus manually, an individual only needs to apply sufficient force to back end 103 of actuator 102 to cause retraction of locking bolt 68. Back end 103 protrudes through slot 57 of latch housing 58 to make both end 103 accessible to manual movement.

Let it now be assumed that it is desired to close the garage door 20 thereby closing of the opening 10. Activating of remote 92 will start the closing operation for the garage door 20. When the garage door 20 is in the completely closed position, activation of the motor 78 is to occur which will cause the actuator 102 to pivot counterclockwise slidingly moving of the locking bolt 68 to extend through the through hole 72 and also to move locking bolt 32 to extend through the through hole 30. When the locking bolts 68 and 32 are moved to their maximum outward position, the reed 108 will abut against the shoulder 116 which will cause deactivation of the motor 78 thereby no further pivoting movement will occur of the actuator 102. In this particular position, the garage door 20 is now locked relative to the door jambs 12 and 14.

When the garage door 20 is in the locked position, the reed switch 110 will also cause transmission of a voltage through a line 18 to an indicator light bulb 120. This indicator light bulb 120 is mounted within the wall 18. This indicator light bulb 120 can be observed exteriorly of the garage door 20 so that when a user comes up to the exterior surface of the door 20, the user can readily see that the garage door is locked by the bulb 20 shining brightly.

The rounded end 106 of the actuator 102 has a somewhat flattened configuration. When the locking bolt 68 is in the position shown in FIG. 4 and the garage door 20 is locked, the face 106 is to be abutted against cutout wall 66. This creates and "over-the-center" position which will prevent movement of the locking bolt 68. If a burglar thinks he or she can deactivate the locking apparatus of this invention by manually moving of the locking bolt 68 to the unlatched position, such is not possible because of the interference it has created by the cutout wall 66 abutting against the rounded end 106 of the actuator 102.

If the electricity to the locking apparatus is not being conducted and it is desired to move the locking apparatus to the unlocked position so that the door 20 can be opened, a manual graspable lanyard 122 is provided which extends exteriorly of the housing 58 and exteriorly of the garage. The lanyard 122 connects to a link 124 which is also mounted on the pivot pin 100 and is fixed to the actuator 102. A coil spring 126 connects between the link 124 and the latch housing 58 with the function of the coil spring 126 is to tend to exert a bias on the link 124 to insure that it is in the position shown in FIG. 4, which is the inactivated position. Pulling on the lanyard 122 will cause the actuator 102 to be pivoted clockwise and cause the locking bolt 68 to be withdrawn from the hole 72 and also cause locking bolt 32 to be withdrawn from hole 30 and will then permit the garage door 20 to be pivotally moved relative to the opening 10.

The latch housing 58 is to be mounted by a plurality of fasteners 128 to the door 20 directly adjacent the left edge 130 of the door 20. The rod 52 is mounted within a guide 132 which is mounted on the latch housing 58 and is located within the internal chamber 56. In a similar manner, the rod 52 is mounted in conjunction with a guide 134 which is mounted on the latch housing 36 and is located within the internal chamber 46.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A locking apparatus for a garage door adapted to be locked to a door jamb comprising:

a first actuator designed to be pivotally mounted on the garage door directly adjacent a first side edge of the garage door, said first actuator being mounted on a carrier gear, a worm gear connecting with said carrier gear, an electric motor to cause rotation of said worm gear and hence pivoting of said carrier gear and said first actuator, said first actuator mounted on a latch housing;

a second actuator designed to be pivotally mounted on the garage door directly adjacent a second side edge of the garage door;

a connecting member connected to both said first actuator and said second actuator so both said first actuator and said second actuator will move in unison;

a first locking bolt connected to said first actuator, movement of said first actuator causes sliding movement of said first locking bolt between a first locking position in conjunction with the door jamb and a first unlocking position spaced from the door jamb;

said first locking bolt having a cutout, said cutout having a cutout wall, said first actuator having a rounded front end which has a somewhat flattened configuration, said flattened configuration to abut against said cutout wall when said first locking bolt is in said first locking position producing an "over-the-center" position which prevents movement of said first locking bolt by interference being created between said first locking bolt and said first actuator, movement of said first locking bolt is only possible by initiating movement of said first actuator;

said first actuator having a back end which extends through a slot formed in said latch housing the first actuator extends exteriorly of said latch housing, said back end being manually accessible to cause said first actuator to pivot to cause said first locking bolt to move;

a second locking bolt connected to said second actuator, movement of said second actuator causes sliding movement of said second locking bolt between a second locking position in conjunction with the door jamb and a second unlocking position spaced from the door jamb; and whereby with said first locking bolt in said first locking position and said second locking bolt in said second locking position the garage door is fixed to the door jamb, whereby with said first locking bolt in said first unlocking position and second locking bolt in said second unlocking position the garage door is movable relative to the door jamb.

2. The locking apparatus as defined in claim 1 wherein:

said first actuator being connected in conjunction with a limit switch, said limit switch, when activated, to cause said first actuator and said second actuator to cease movement.

3. The locking apparatus as defined in claim 1 wherein:

said first locking bolt being movable in a direction opposite to movement of said second locking bolt.

4. The locking apparatus as defined in claim 1 wherein:

said first locking bolt being linearly movable, said second locking bolt being linearly movable.

5. The locking apparatus as defined in claim 1 wherein:

pivotable movement of said first actuator being in the same direction as the pivotable movement of said second actuator.

6. The locking apparatus as defined in claim 1 wherein:

said connecting member comprising a thin rod.

* * * * *